US005915393A

United States Patent [19]

DeVenuto

[11] Patent Number: 5,915,393

[45] Date of Patent: Jun. 29, 1999

[54] APPARATUS AND METHOD FOR PREPARING HAIR FOR A HIGHLIGHTING PROCEDURE

[76] Inventor: Lisa DeVenuto, 37 N. Sugan Rd., New Hope, Pa. 18938

[21] Appl. No.: 09/135,449

[22] Filed: Aug. 17, 1998

[51] Int. Cl.[6] ..... A45D 19/18

[52] U.S. Cl. ..... 132/208; 132/270; 132/139; 132/154

[58] Field of Search ..... 132/208, 151, 132/152, 154, 156, 160, 270, 139

[56] References Cited

U.S. PATENT DOCUMENTS

| | | | |
|---|---|---|---|
| 883,598 | 3/1908 | Warren | 132/151 |
| 2,678,048 | 5/1954 | Poetto | 132/156 |
| 3,302,653 | 2/1967 | D'Agostino | 132/270 |
| 3,477,446 | 11/1969 | Terrenzio et al. | 132/208 |
| 3,749,105 | 7/1973 | Sestita | 132/208 |
| 4,289,150 | 9/1981 | Kimball | 132/208 |
| 4,325,393 | 4/1982 | Thomas | 132/151 |
| 4,732,170 | 3/1988 | Thomas | 132/151 |
| 4,961,439 | 10/1990 | Hartmann | 132/270 |
| 4,996,996 | 3/1991 | Hirsh | 132/160 |

FOREIGN PATENT DOCUMENTS

| | | | |
|---|---|---|---|
| 2503729 | 8/1976 | Germany | 132/201 |
| 21559 | of 1909 | United Kingdom | 132/152 |

*Primary Examiner*—Todd E. Manahan
*Attorney, Agent, or Firm*—LaMorte & Associates

[57] ABSTRACT

A device for pulling segments of hair through a thin plastic highlighting grid that is placed upon a person's head includes an elongated body having a longitudinal axis. A plurality of pick elements extend from the elongated body. Each of the pick elements has a hook is formed at a first end. Each of the pick elements is spaced apart by a distance sufficient to enable a person's fingers to pass in between the pick elements when gripping the elongated body. In the method of use of the device, a highlighting grid is placed over a person's head of hair. The highlighting grid contains individual grid blocks printed thereon. The pick elements are used to simultaneously pierce a plurality of grid blocks on the highlighting grid. The pick elements pass through the highlighting grid and engage segments of hair on the head of hair. As the pick elements are simultaneously retracted back through the highlighting grid, each of the pick elements pulls a segment of hair through the highlighting grid.

16 Claims, 3 Drawing Sheets

APPARATUS AND METHOD FOR PREPARING HAIR FOR A HIGHLIGHTING PROCEDURE

BACKGROUND OF THE INVENTION

1. Field of the Invention

In general, the present invention relates to devices and methods of separating individual segments of hair from a head of hair prior to a highlighting dyeing procedure. More particularly, the present invention relates to hand held tools that are used to engage and separate segments of hair to be dyed.

2. Description of the Prior Art

Each year there are thousands of people who have their hair highlighted. In a highlighting procedure, segments of hair are separated from the head of hair at various points around the head. These separated segments are then dyed. The result is a head of hair where only some of the hairs are dyed. Thus, the head of hair is highlighted with the color of the dyed hair even though most of the hair has not been dyed.

Different hair stylists dye hair in different ways. Some stylists separate the segments of hair to be dyed by hand. However, unless the hair stylist is very well trained, it is difficult to evenly separate segments of hair symmetrically around the head. If even segments of hair are not separated symmetrically around a person's head, the highlighting will be uneven and the hair in one section of the person's head may appear a different shade than the hair in other sections. A person may then have a hair style that gives an unnatural appearance.

One of the most common ways to ensure that segments of hair are evenly separated for a highlighting procedure is for a hair stylist to use a highlighting grid and a pick. A highlighting grid is a transparent hood that can be placed over the head of a person whose hair is to be highlighted. The hood is made of a thin plastic that is easily punctured. A symmetrical grid of blocks is printed on the hood. The blocks can be anywhere from ¼ inch square to 1 inch square, depending upon the type of highlighting procedure to be performed. After the highlighting grid is placed over a patron's head, a pick is used to puncture the highlighting grid in each of the blocks. The pick has a hook at one end. Once the pick is punctured through the highlighting grid, the hook engages a small segment of hair below the highlighting grid. As the pick is pulled back up through the highlighting grid, the hook at the end of the pick pulls a segment of hair back up through the highlighting grid. The size of the hook determines how much hair is pulled through the highlighting grid. The larger the hook, the more hair is pulled through the highlighting grid.

By using the highlighting grid and the pick, a hair stylist can symmetrically expose nearly identical segments of hair across a person's head. The segments of hair are also isolated from the remaining hair of the head by the presence of the highlighting grid. The separated segments of hair are therefore readily dyed.

A disadvantage of prior art highlighting grid and pick systems is that it takes a great deal of time and labor for a hair stylist to puncture the dozens of blocks on the highlighting grid with a pick and extract the proper amount of hair through the highlighting grid with the pick. Since the cost of a highlighting service is directly proportional to the hair stylist's time, the use of a prior art highlighting grid adds significantly to the cost of the service.

A need therefore exists in the art for a device and method for pulling hair through a highlighting grid that is faster and more efficient than prior art picks. This need is provided for by the present invention as set forth in the below description and claims.

SUMMARY OF THE INVENTION

The present invention is a device for pulling segments of hair through a thin plastic highlighting grid that is placed upon a person's head. The device includes an elongated body having a longitudinal axis. A plurality of pick elements extend from the elongated body. Each of the pick elements has a first end and a second end, wherein a hook is formed at each first end. Each of the pick elements is spaced apart by a distance sufficient enough to enable a person's fingers to pass in between the pick elements when gripping the elongated body.

The device is used in a method of separating segments of hair from a head of hair. In the method of use, a highlighting grid is placed over a person's head of hair. The highlighting grid contains individual grid blocks printed thereon. The pick elements are used to simultaneously pierce a plurality of grid blocks on the highlighting grid. The pick elements pass through the highlighting grid and engage segments of hair on the head of hair. As the pick elements are simultaneously retracted back through the highlighting grid, each of the pick elements pulls a segment of hair through the highlighting grid.

BRIEF DESCRIPTION OF THE DRAWINGS

For a better understanding of the present invention, reference is made to the following description of an exemplary embodiment thereof, considered in conjunction with the accompanying drawing, in which.

DETAILED DESCRIPTION OF THE INVENTION

The present invention is a device that embodies multiple pick elements. Such a device is used in conjunction with traditional highlighting grids, wherein the multiple pick elements can be used to pierce multiple blocks of the highlighting grid, simultaneously.

Figure 1:
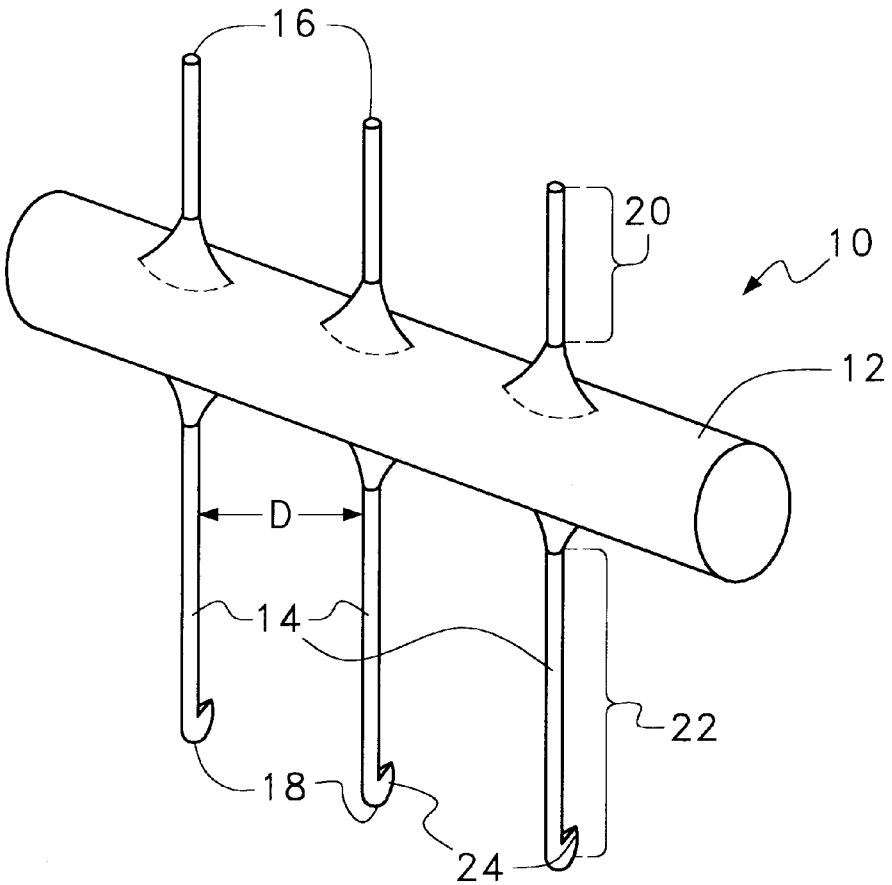
FIG. 1 is a perspective view of an exemplary embodiment of a device in accordance with the present invention.

Referring to FIG. 1, an exemplary embodiment of a device 10 is shown in accordance with the present invention. The device 10 includes an elongated body 12. In the shown embodiment, the elongated body 12 has a circular cross-section. However, it should be understood that the elongated body 12 can have different cross-sectional shapes, such as that of a square, rectangle, ellipse or the like.

Multiple pick elements 14 extend through the elongated body 12. In the shown embodiment, three pick elements 14 are shown by way of example. However, it should be understood that any plurality of pick elements can be used. Preferably, each device has between two pick elements and five pick elements.

Regardless of the number of pick elements 14 present, each of the pick elements 14 has a top end 16 and a bottom end 18. A first segment 20 of each pick element 14, proximate the top end 16, extends above the elongated body 12. Each of the pick elements 14 intersect the elongated body 12 at a right angle. As a result, the first segment 20 of each of the pick elements 14 extends away from the elongated body 12 in parallel rows. A second segment 22 of each of the pick elements 14 extends below the elongated body 12. Again, the second segment 22 of each of the pick elements 14 extend away from the elongated body 12 in parallel rows. The bottom end 18 of each of the pick elements terminates with a hook 24. The hook 24 has the same configuration as hooks used on prior art picks.

Figure 2:
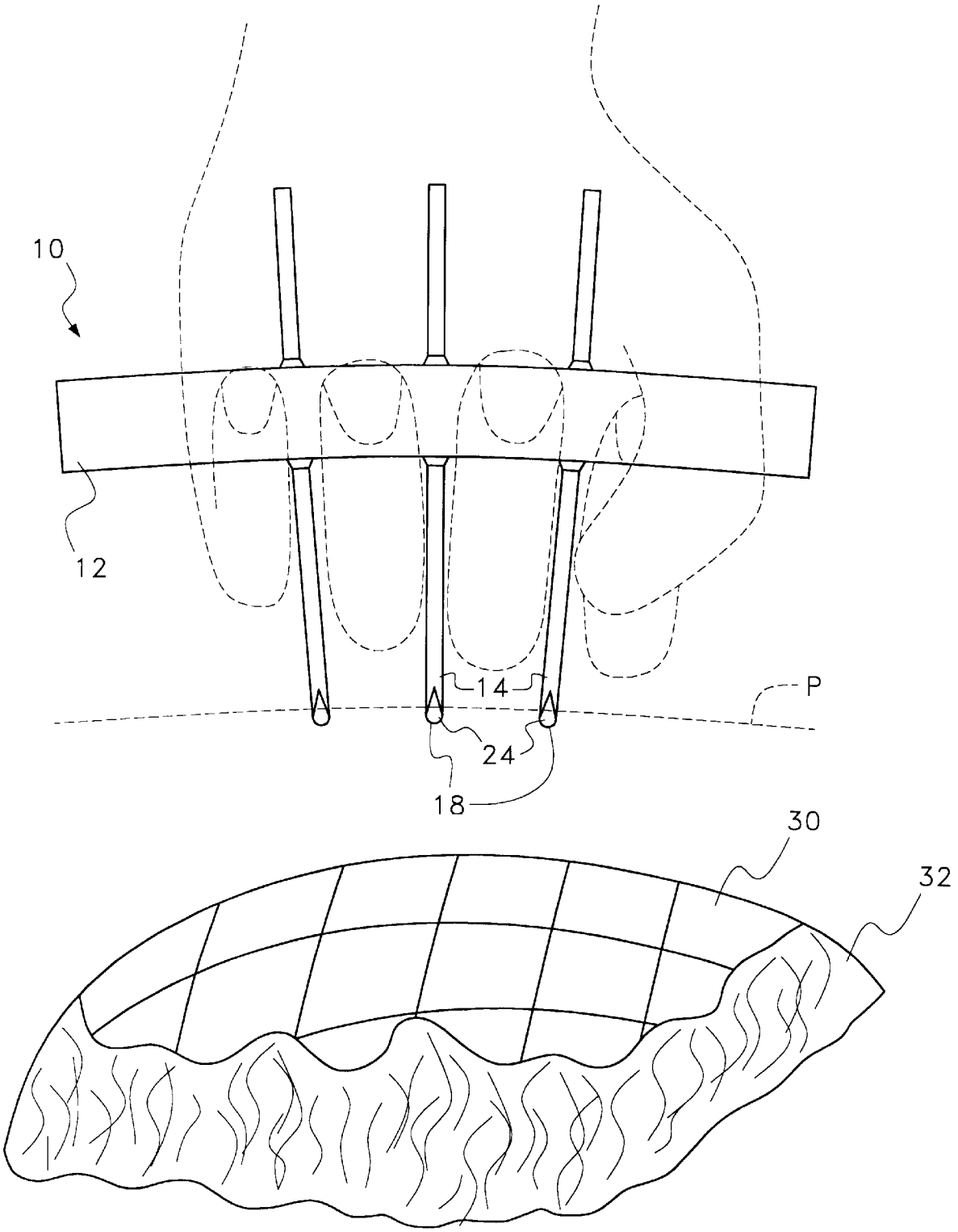
FIG. 2 is a front view of the embodiment of FIG. 1, shown deformed by a hand and shown accompanied by a fragmented section of a highlighting grid placed on a person's head.

Each of the pick elements 14 is separated by a distance D. The distance D between pick elements is large enough for a hair stylist's finger to fit therein. Referring to FIG. 2, it can be seen that a hair stylist holds the device 10 by gripping the elongated body 12 of the device 10 in between pick elements 14. The elongated body 12 of the device 10 is preferably made of a plastic material or an elastomeric material that can be elastically bent when gripped in the palm of a hair stylist's hand. As a result, when the elongated body 12 is gripped, the elongated body 12 bends and the pick elements 14 leave their initial parallel orientation. As a result, the hooks 24 at the bottom end 18 of the pick elements 14 fall along a curved path P. The radius of curvature of the curved path P is controlled by the hair stylist gripping the elongated body 12 of the device 10. The harder the hair stylist grips the elongated body 12, the more it deforms and the greater the radius of curvature becomes. Consequently, a hair stylist can cause the device 10 to conform to the radius or curvature of a highlighting grid 30 placed upon a patron's head 32. Additionally, by changing the degree of deformation in the elongated body 12, a hair stylist can cause the device 10 to match the changing radius of curvature at different points on the patron's head 32.

Figure 3:
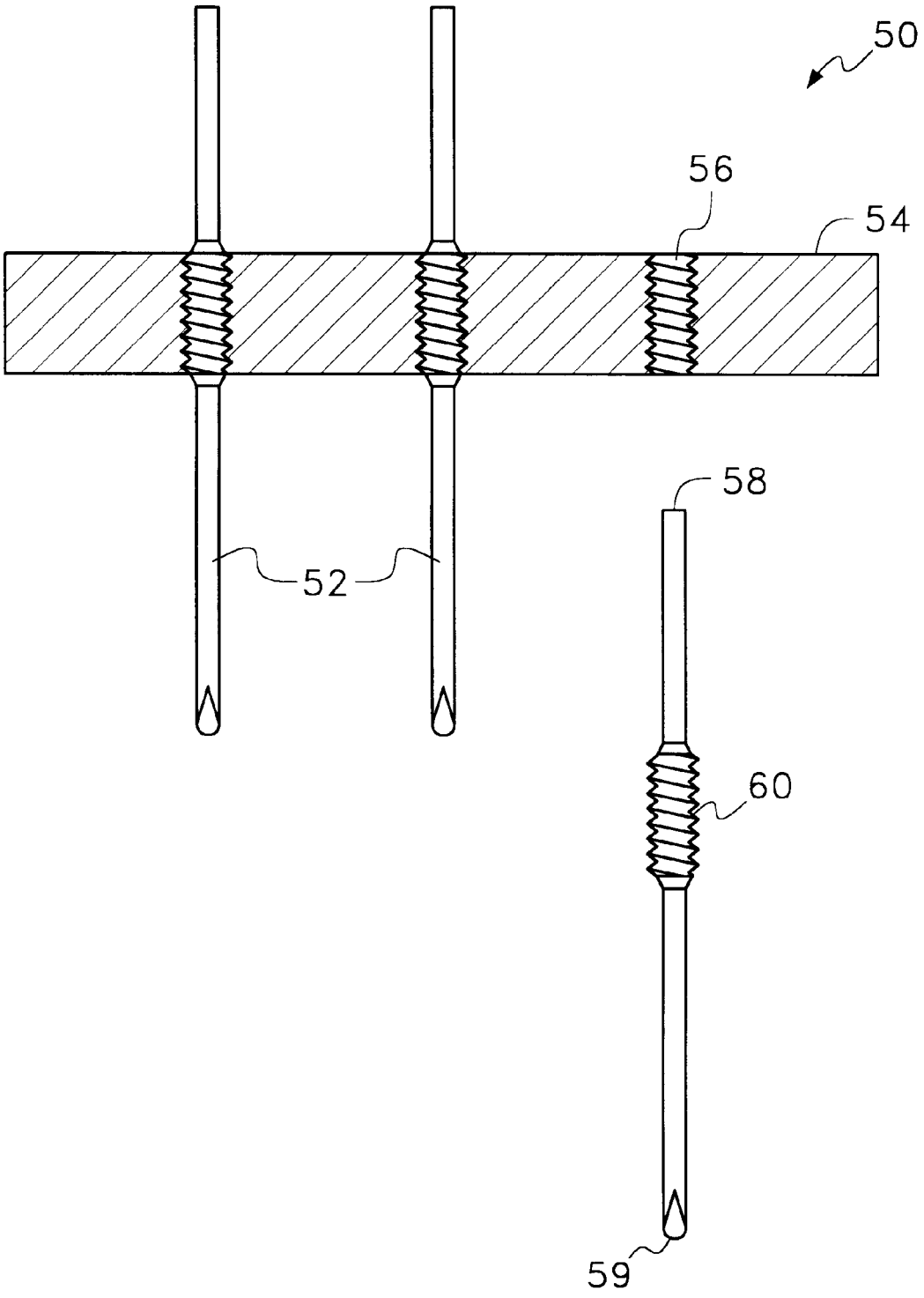
FIG. 3 is a cross-sectional view of an alternate embodiment of a device in accordance with the present invention.

The pick elements and the elongated body can be integrally molded as a single unit. Alternatively, the pick elements can be selectively attachable and detachable from the elongated body. Referring to FIG. 3, an alternate embodiment of the device 50 is shown, wherein the pick elements 52 can be selectively added or removed.

In FIG. 3, the elongated body 54 has a plurality of threaded apertures 56 that extend from one side of the elongated body 54 to the other. The pick elements 52 have a top end 58 and a bottom end 59. A segment of each pick element 52 contains threading 60 that is sized to engage the threaded aperture 56 in the elongated body 54. Consequently, different pick elements 52 can be added or removed from the elongated body 54 as desired. This enables a hair stylist to change the size of the pick elements 52 or the number of pick elements 52 as desired.

It will be understood that the embodiment of the present invention described and illustrated herein is merely exemplary and a person skilled in the art can make many variations to the embodiment shown without departing from the scope of the present invention. It should also be understood that the various elements from different embodiments can be mixed together to create alternate embodiments that are not specifically described. All such variations, modifications and alternate embodiments are intended to be included within the scope of the present invention as defined by the appended claims.

What is claimed is:

1. A device for pulling segments of hair through a highlighting grid, comprising:

an elongated body having a longitudinal axis; and a plurality of pick elements, each extending from said elongated body, each of said pick elements having a first end and a second end, wherein each said first end contains a hook and wherein each of said pick elements is spaced apart by a distance sufficient enough to enable a person's fingers to pass in between said pick elements when gripping said elongated body, wherein said elongated body intersects each of said pick elements between said first end and said second end, whereby both said first end and said second end of said pick elements extend from said elongated body.

2. The device according to claim 1, wherein said elongated body is flexible.

3. The device according to claim 1, wherein said pick elements are parallel as they extend from said elongated body.

4. The device according to claim 3, wherein said pick elements extend from said elongated body at a general perpendicular to said longitudinal axis of said elongated body.

5. The device according to claim 1, wherein said pick elements are selectively detachable from said elongated body.

6. The device according to claim 1, wherein said pick elements and said elongated body are integrally molded as a single unit.

7. The device according to claim 1, wherein said elongated body has a plurality of threaded apertures extending therethrough and said pick elements contain external threaded adapted to engage said threaded apertures.

8. The device according to claim 1, wherein each of said pick elements are spaced at least ½ inch apart.

9. The device according to claim 1, wherein said pick elements are between two and five in number.

10. A method of separating segments of hair from a head of hair, comprising the steps of:

placing a highlighting grid over the head of hair, wherein the highlighting grid contains individual grid blocks;

simultaneously piercing a plurality of grid blocks on said highlighting grid with a plurality of hooks, wherein said hooks extend from a common elongated body and are passed through the highlighting grid to engage segments of hair on the head of hair; and simultaneously retracting said plurality of hooks back through said highlighting grid, wherein each of said hooks pulls a segment of hair through said highlighting grid.

11. The method according to claim 10, wherein said elongated body is flexible.

12. The method according to claim 10, wherein said plurality of hooks are parallel as they extend from said elongated body.

13. The method according to claim 10, wherein said plurality of hooks ar e selectively detachable from said elongated body.

14. The method according to claim 10, wherein said plurality of hooks and said elongated body are integrally molded as a single unit.

15. The method according to claim 10, wherein said elongated body has a plurality of threaded apertures extending therethrough and said plurality of hooks contain external threaded adapted to engage said threaded apertures.

16. The method according to claim 10, wherein each of said plurality of hooks are spaced at least ½ inch apart.

* * * * *